United States Patent [19]

May et al.

[11] Patent Number: 4,568,899

[45] Date of Patent: Feb. 4, 1986

[54] GROUND FAULT ACCESSORY FOR A MOLDED CASE CIRCUIT BREAKER

[75] Inventors: William E. May, Lawrenceville; William R. Taylor, Decatur; Peter N. C. Pang, Lawrenceville, all of Ga.

[73] Assignee: Siemens Aktiengesellschaft, Munich and Berlin, Fed. Rep. of Germany

[21] Appl. No.: 593,858

[22] Filed: Mar. 27, 1984

[51] Int. Cl.[4] ..... H01H 83/02; H01H 73/06

[52] U.S. Cl. ..... 335/18; 335/20

[58] Field of Search ..... 361/42, 43, 44, 115, 361/395, 399, 356, 357; 335/18, 19, 20

[56] References Cited

U.S. PATENT DOCUMENTS

| | | | |
|---|---|---|---|
| 3,784,940 | 1/1974 | DeTorre | 335/18 |
| 3,999,103 | 12/1976 | Misencik et al. | 335/18 |
| 4,093,977 | 6/1978 | Wilson | 335/18 |
| 4,112,270 | 9/1978 | Rys | 200/50 C |
| 4,203,760 | 6/1980 | DiMarco et al. | 335/17 |
| 4,281,359 | 7/1981 | Bayer et al. | 335/18 |
| 4,363,063 | 12/1982 | Erickson | 335/18 |
| 4,412,193 | 10/1983 | Bienwald et al. | 335/18 |

*Primary Examiner*—Harold Broome

*Attorney, Agent, or Firm*—F. W. Powers; J. L. James

[57] ABSTRACT

A ground fault accessory for a molded case circuit breaker is provided by converting a shunt trip accessory to automatically trip the breaker when a ground fault occurs. A printed circuit mounted in the housing with the shunt trip eliminates the need for a separate ground fault relay. The ground fault relay and the shunt trip are made available in the same accessory requiring no additional mounting of equipment or external wiring while conserving space which is scarce in load centers and other locations where both ground fault and shunt trip are desired.

12 Claims, 6 Drawing Figures

GROUND FAULT ACCESSORY FOR A MOLDED CASE CIRCUIT BREAKER

TECHNICAL FIELD

This invention relates to accessories for molded case circuit breakers and, more particularly, to a ground fault accessory for a molded case circuit breaker which can be installed in the field.

BACKGROUND ART

In certain types of electrical equipment, such as load centers, for example, it is desirable to have a circuit breaker for making and breaking circuits under controlled conditions as well as to interrupt circuits when overload conditions occur. In a load center having a molded case circuit breaker, the circuit breaker mounts into the enclosure and is keyed into a fixed position and is bolted to the electrical bus supplying power. Needless to say, in the enclosure space is at a premium. It is therefore desirable to provide ground fault circuit interruption protection in the load center in the space available. Traditionally, ground fault protection has been provided for these circuit breakers by providing a separately mounted ground fault relay which is then wired to the trip accessory on the circuit breaker. While this scheme works reasonably well, it requires additional space and the relay has to be mounted remotely from the circuit breaker which requires extra time and materials which increase cost. Also, this method is not well suited for field installation.

Another scheme uses a separately mounted ground fault relay and coil remote from a circuit breaker which are connected to a circuit breaker that is equipped with a shunt trip accessory. U.S. Pat. No. 4,209,760 which issued to Bernard DiMarco et al on June 24, 1980 and U.S. Pat. No. 4,112,270 which issued to T. J. Rys on Sept. 5, 1978 disclose circuit breakers with accessories. DiMarco discloses a multi-pole circuit breaker which has a molded insulating housing which defines an external cavity in which an shunt trip assembly is removably mounted. The shunt trip assembly includes an electromagnet with an operating member which engages the cradle latch to release the latter and automatically trip the circuit breaker. When ground fault protection is desired a ground fault relay signals the shunt trip assembly and causes the circuit breaker to trip. Again this requires additional parts, is costly and requires labor and is not the sort of thing that lends itself to installation in the field.

Rys discloses a single pole circuit breaker module constructed so that its housing is provided with frangible sections aligned with the pivot pins for the contact arm, the cradle and the operating mechanism latch. These pins are keyed to the elements mounted theron and each pin is provided with a formation to engage a complementary formation projecting sideways from the auxiliary feature module. In the case of a shunt trip auxiliary module the solenoid operated member thereof is operatively connected to the pivot for the circuit breaker latch whereby actuation of the shunt trip solenoid serves to move the latch to its unlatched position for tripping of the circuit breaker. Again, however, extra parts and space are required to provide ground fault protection. It is desirable to provide ground fault protection ulitizing the existing space.

There are circuit breakers that have ground fault circuit protection built as an integral part of the breaker.

However this type of breaker necessarily is more expensive and bulkier than a standard breaker without the ground fault circuit protection. It is desirable to have a simple circuit breaker to which a ground fault accessory could be added in the field. This arrangement would allow a user to install the circuit breaker and add the ground fault protection when needed as convenient. Again however, space constraints are critical and must be taken into account when accessories are added.

A bolt-on accessory for a molded case circuit breaker does exist which can be added in the field in the very limited space constraints of a load center. However, this accessory only has a shunt trip accessory, not a ground fault accessory. Thus, the problem again presents itself that there is no available ground fault bolt-on accessory available. For a motor controller the shunt trip accessory is more or less a necessity because the shunt trip accessory usually includes an under voltage relay and other features which are desirable in a load center. Thus, even if a ground fault accessory were available in the same size package as the shunt trip accessory, there still would not be enough room in the load center for the addition of both the shunt trip and the ground fault relay. What is needed is a bolt-on accessory containing both the ground fault and shunt trip protection. It is desirable to have the ground fault and the shunt trip protection available in the same accessory.

The present invention is directed to overcoming one or more of the problems set forth above.

DISCLOSURE OF INVENTION

In one aspect of the invention, a ground fault accessory for a circuit breaker for protecting a load circuit comprises a base which has a front portion and a cover which has a front portion and is mateable with the base and defines a chamber when mated. A terminal strip is mounted on the front portions of the base and cover and means are provided for attaching the base and cover to the circuit breaker as a unit. A shunt trip assembly is mounted on the base within the chamber and is operable to trip the circuit breaker when actuated. A circuit board is connected to the base and has a circuit connected to the shunt trip assembly and the terminal strip. The circuit selectively actuates the shunt trip assembly in response to receiving a preselected signal.

In another aspect of the invention, a method for converting a shunt trip accessory for a molded case circuit breaker to a ground fault accessory includes the steps of dividing the shunt trip accessory into a base and a cover and mounting a circuit board having a circuit on the base. The method also includes connecting the shunt trip assembly to the circuit, connecting the circuit to a terminal strip mounted on the front portions of the base and cover and connecting the base and cover.

The present invention provides the ground fault and the shunt trip protection in the same accessory package. Because the ground fault and shunt trip accessories are available in the same accessory package, there is a savings of space, material and labor, as well as time. Because the shunt trip accessory can be transformed into a combination shunt trip unit and ground fault unit relay, existing shunt trip units already in service in the field can be retrofitted.

DETAILED DESCRIPTION

Figure 1:
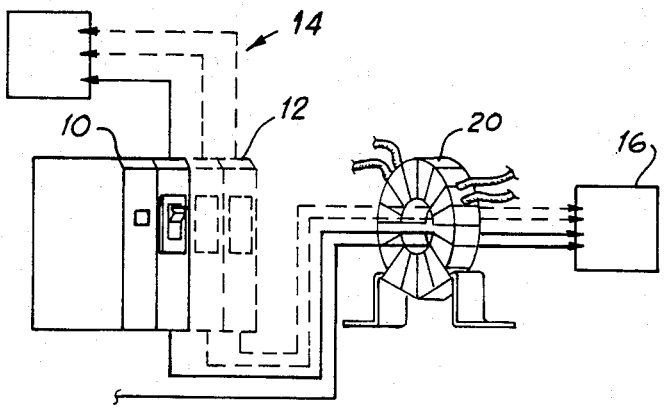
FIG. 1 is a schematic diagram showing a molded case circuit breaker incorporating an embodiment of the present invention.

Referring to FIG. 1, a ground fault accessory 10 is provided for a circuit breaker 12 which is part of a load center 14 which controls power flow to and protects a load 16. The circuit breaker 12 and ground fault accessory 10 are electrically located between the load 16 and the line 18. A sensor coil 20 is located between the load 16 and the circuit breaker 12 and ground fault accessory 10. The sensor coil 20 is a toroidal coil, as is known in the art, and the lines from the circuit breaker to the load pass through the center of this donut shaped coil.

Figure 2:
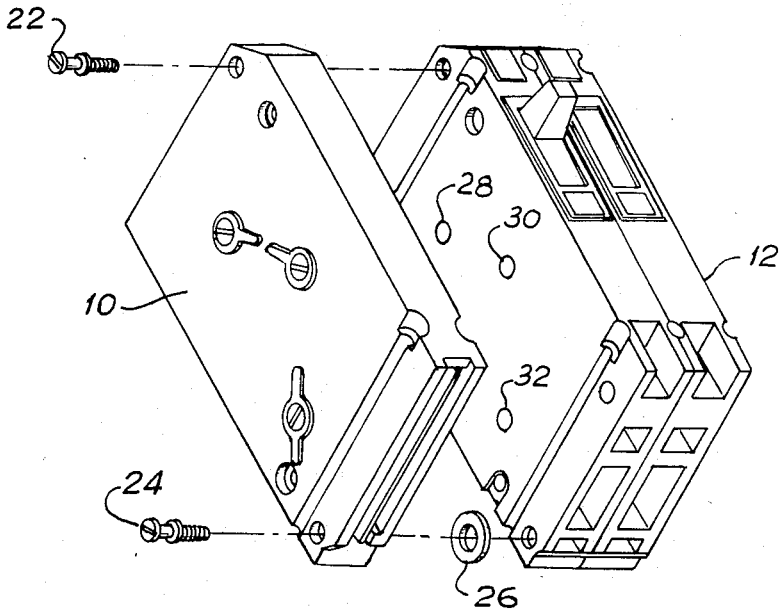
FIG. 2 is an exploded view showing the interconnection between the accessory and the circuit breaker.

Referring to FIG. 2, the ground fault accessory 10 is connected to circuit breaker 12 preferably by two screws 22 and 24. The screws 22 and 24 are preferably self-tapping screws which tap into available holes in the circuit breaker 12. An insulating washer 26 is placed between the ground fault accessory 10 and the circuit breaker 12. Knockouts 28, 30 and 32 are available on the circuit breaker 12 and, when removed, expose portions of the breaker 12 which are mateable with portions of the accessory 10, so that the accessory and breaker are mechanically linked through these knockouts. For example when knockout 30 is removed, the trip latch pin in the breaker is accessible to trip the breaker.

Figure 5:
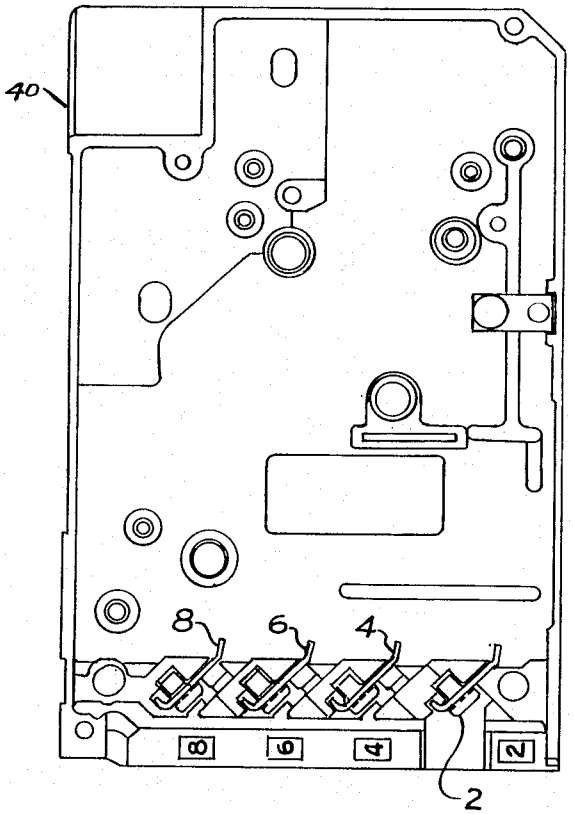
FIG. 5 is a right side view of the interior of the accessory.
Figure 3:
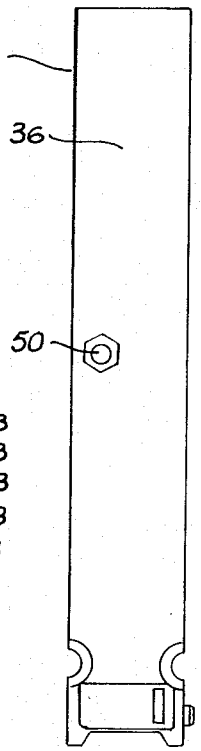
FIG. 3 is a front view of the accessory.
Figure 4:
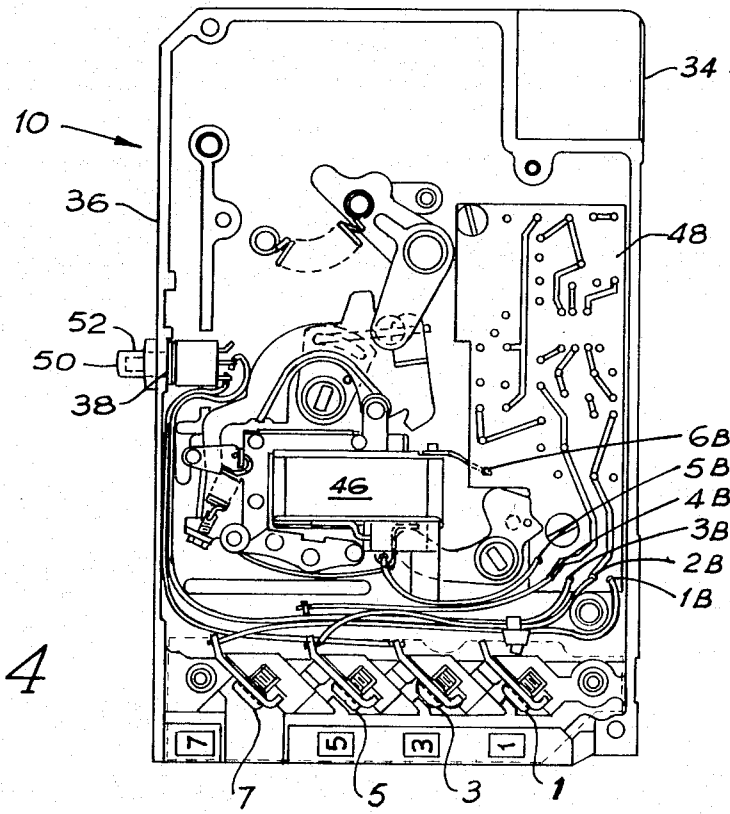
FIG. 4 is the left side view of the interior of the accessory.

Referring to FIG. 4, the ground fault accessory 10 has a base portion 34 which has a front portion 36 with an opening 38. The ground fault accessory also has a cover 40 (FIG. 5). The cover 40 has a front portion 42 and is mateable with the base 34 and defines a chamber therein when mated. The base 34 and cover 40 are sometime referred to as the base half and the cover half because of their cup or dish-like shape which accomodates the positioning of components within either portion. A terminal strip 44 (FIG. 6) is mounted on the end portions of the base 34 and cover 40. A shunt trip assembly 46 is mounted on the base 34 within the chamber and is operable to trip the circuit breaker 12 when actuated. When connected the shunt trip assembly 46 fits through knockouts 28 and 30 to engage the circuit breaker 12 and trip it when the shunt trip assembly 46 is actuated.

A printed circuit board 48 is connected to the base 34 and has a circuit thereon which is connected to the shunt trip assembly 46 and to the terminal strip 44. The circuit selectively actuates the shunt trip assembly 46 in response to receiving a preselected signal at the terminal strip 44 which signal is indicative of a ground fault in the load circuit 16.

The screws 22 and 24 connect the base 34 and cover 40 together and connect them to the circuit breaker 12 as a unit. The base portion 34 preferably contains a number of holes and the circuit board 48 is preferably connected to the base 34 and secured with self-threading screws which are forced into the holes. By this construction the circuit board 48 is firmly connected to the base 34 and can withstand shocks and changes of position which it must undergo in the field during installation, removal, operation and repair.

A switch 50 is mounted on the base 34 over the base opening 38. This switch 50 has one terminal connected to the circuit board 48 and the other terminal connected to the terminal strip 44. This switch 50 provides a self-test test function as will be more fully explained hereinafter. An insulating protector, preferably a rubber boot 52, is positioned over the exposed part of the switch 50 so that no metal is exposed on the surface of the accessory 10. A threaded shaft is attached to the switch 50 and extends through the opening 38 in the base and a nut is threaded on the shaft to secure the switch 50 in position. This switch 50 is added to the accessory molding at the top of the case to provide for a self-test function. The exposed portion of the switch 50 is covered with a rubber boot 52 to eliminate any exposed metal parts on the outside of the case. One terminal of the switch 50 is connected to the circuit board 48 with a length of insulated stranded wire and the other terminal of the switch 50 is connected to a customer accessible terminal pad 44 on the end of the case, 34, 40.

The circuit board 48 is also connected to the shunt trip coil on the shunt trip assembly 46. Other leads of the circuit board 48 are connected to the customer accessible terminals 44 for attachment of the leads to the current transformer sensor 20. A bolt-on shunt trip accessory 10 for a molded case circuit breaker 12 can be converted to a ground fault accessory 10 by dividing the shunt trip accessory into a base portion 34 and a cover portion 40, mounting a circuit board 48 on the base 34, connecting the shunt trip assembly 46 to the circuit, connecting the circuit to the terminal strip 44 mounted on the end portion of the base 34 and cover 40 and connecting the base 34 and cover 40 again.

Referring to FIG. 1, the sensor coil 20 may be panel or gutter mounted at a convenient location in the load center. Without the present invention, it would be necessary to also separately mount a ground fault relay and to connect that relay to the shunt trip accessory of the breaker. The present invention allows for the ground fault relay and the shunt trip to be available in the same accessory requiring no additional mounting of equipment or external wiring at great savings to the user in space, material and in labor. The sensor coil 20 preferably has four leads of which two are white, one is green and one is gray. The two white leads are connected to terminals 2 and 3 on the terminal strip 44, the green lead attaches to terminal 5 and the gray lead attaches to terminal 7. The control voltage, preferably 120 VAC, must be applied to terminals 1 and 2. Terminals 8, 6 and 4 are connected to the common, normally closed and normally open contacts, respectively, of an auxiliary switch. The auxiliary switch can operatee a bell alarm or other signalling device.

Figure 6:
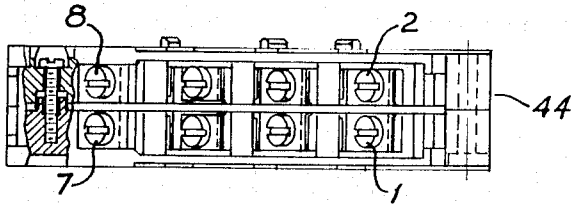
FIG. 6 is an end view showing the terminal strip.

Referring to FIGS. 4–6, the terminal strip 44 has terminals 1 through 8 and the circuit board 48 has terminals 1B through 6B. Terminals 1B, 2B, 4B are connected to terminals 7, 5 and 2, respectively. Terminals 5B and 6B are connected to the shunt trip unit 46 and terminal 3B is connected to the switch 50. The other switch terminal is connected to terminal 1. By this construction, the push-to-test feature of the switch 50 can be used to test for control voltage presence and ground fault circuit operation. The breaker 12 should immediately trip if about 55% or more of the control voltage is available. A loss of the 120 VAC control voltage renders the ground fault sensing relay inoperative but the breaker will continue to function in a normal manner.

In operation, the power leads to the load 16, three in the case of the three phase circuit and two for a single phase circuit plus the neutral wire if the circuit has one, are passed through the external sensor 20. The magnetic flux in the core of this sensor is a direct result of the sum of the currents through it. Under normal conditions, this sum is zero. When a ground fault is experienced, however, the unbalance causes flux to circulate in the core. This flux in turn causes the current to flow in a secondary winding of the sensor. The current in the secondary of the sensor is detected by the electronic circuit which is designed to react to primary currents of at least 30 milliamperes. Of course for different conditions, different current thresholds can be used. However, in the present embodiment, the circuit is designed to react to primary currents of 30 milliamperes. Above this current, the circuit provides a proper time delay and finally allows power to flow to the shunt trip coil. This shunt trip coil mechanically trips the attached circuit breaker in response to the ground fault. Thus, an effective ground fault protection system is provided along with the normal shunt trip in the same housing. The accessory unit can be installed or removed in the field using simple tools. More importantly, ground fault and shunt trip protection are provided in the same space. The present invention allows for the ground fault relay, the shunt trip and alarm switch to be available in the same accessory requiring no additional mounting of equipment or external wiring at great savings to the user in space, material and labor.

Other aspects, objects and advantages of the present invention will become apparent from a study of the specification, drawings and appended claims.

What is claimed is:

1. A ground fault accessory for a circuit breaker for protecting a load circuit, comprising:

a base having a front portion with an opening;

a cover having a front portion and being mateable with the base and defining a chamber when mated;

a terminal strip mounted on the front portions of the base and the cover;

means for attaching the base and the cover as a unit to the circuit breaker;

a shunt trip assembly mounted on the base within the chamber and operable to mechanically trip the circuit breaker when actuated; and a circuit board connected to the base and having a circuit connected to the shunt trip assembly and the terminal strip, said circuit selectively actuating the shunt trip assembly in response to receiving a preselected signal at the terminal strip indicative of a ground fault in the load circuit.

2. A ground fault accessory, as set forth in claim 1, wherein the base contains a hole and the circuit board is secured to the base with a screw.

3. A ground fault accessory, as set forth in claim 1, wherein the base is formed with a plurality of holes therein and the circuit board is secured with a self-tapping screw for each hole.

4. A ground fault accessory, as set forth in claim 1, including:

a switch mounted on the base over the base opening and having one terminal connected to the circuit board and the other terminal connected to the terminal strip.

5. A ground fault accessory, as set forth in claim 4, including:

a threaded shaft attached to the switch and extending through the opening and;

a nut threaded on the shaft securing the switch.

6. A ground fault accessory, as set forth in claim 4, including a rubber boot covering the switch protruding from the front of the base.

7. A method for converting a shunt trip accessory for a molded case circuit breaker to a ground fault accessory, comprising the steps of:

dividing the shunt trip accessory into a base and a cover, said base having a front portion with an opening, said cover having a front portion and being mateable with the base and defining a chamber when mated, said base having a shunt trip assembly mounted thereon within the chamber operable to mechanically trip the circuit breaker when actuated;

mounting a circuit board on the base, said circuit board having a circuit;

connecting the shunt trip assembly to the circuit connecting the circuit to a terminal strip mounted on the front portions of the base and cover; and connecting the base and cover.

8. A method, as set forth in claim 7, including forming a hole in the base securing the circuit board to the base with a self-tapping screw in the hole.

9. A method, as set forth in claim 7, including:

mounting a switch on the front portion of the base over the opening; and securing the switch.

10. A method, as set forth in claim 9, including:

placing a rubber boot over the switch; and covering exposed metal parts of the switch.

11. A method, as set forth in claim 9, including:

connecting one terminal of the switch to the circuit; and connecting the other terminal to the terminal strip.

12. A method, as set forth in claim 7, including: connecting an external ground fault sensor to the terminal strip.

* * * * *